United States Patent [19]

Komoto et al.

[11] Patent Number: 4,474,321

[45] Date of Patent: Oct. 2, 1984

[54] CONTROL UNIT FOR DRIVING PLURAL LOOPERS

[75] Inventors: Haruo Komoto; Shigeharu Hamada, both of Hyogo, Japan

[73] Assignee: Mitsubishi Denki Kabushiki Kaisha, Tokyo, Japan

[21] Appl. No.: 426,124

[22] Filed: Sep. 28, 1982

[30] Foreign Application Priority Data

Sep. 29, 1981 [JP] Japan ..... 56-155839

[51] Int. Cl.[3] ..... B65H 23/16

[52] U.S. Cl. ..... 226/113; 226/118; 242/75.51

[58] Field of Search ..... 226/42, 118, 119, 43, 226/113; 242/75.51; 318/6, 7

[56] References Cited

U.S. PATENT DOCUMENTS 1,265,328 5/1918 Henderson ..... 226/42

2,707,254 4/1955 Newman et al. ..... 318/6

2,797,918 7/1957 McArthur et al. ..... 226/42

FOREIGN PATENT DOCUMENTS 14709 5/1978 Japan .

*Primary Examiner*—Stuart S. Levy

*Assistant Examiner*—Lloyd D. Doigan

*Attorney, Agent, or Firm*—Bernard, Rothwell & Brown

[57] ABSTRACT

A novel control unit for driving plural loopers provided with a tension constant automatically adjusting circuit in which a looper speed on its slave side is controlled such that a plurality of loopers having different amounts for moving the loopers and different strand numbers pass through the same % positions at the same time in order to control these plural loopers, and the number of times in operation for correcting an error of % position which takes place at the time of stopping transference of the plural loopers is minimized.

2 Claims, 2 Drawing Figures

CONTROL UNIT FOR DRIVING PLURAL LOOPERS

BACKGROUND OF THE INVENTION

1. Field of the Invention

The present invention relates to a novel control unit for driving and controlling a plurality of loopers, and particularly to a control unit for comprehensively controlling a plurality of loopers having different amounts for transferring the same and different strand numbers.

2. Description of the Prior Art

Generally, in an installation for processing strip-like materials or the like, it is required to join the succeeding material to the preceding material by means of welding or the like in order to perform continuously such processing. For this reason, operation in such installation for processing must be stopped because of working for cutting, welding and the like of the strip-like materials. Thus, for the sake of making continuously the following principal working such as the processing itself and the like possible during stop of supplying such material, a loop or loops are disposed on the route of transferring material in the installation.

Formerly, such loop was a free loop to which no tension had been applied, but in such free loop, meandering of a material or the like became remarkable in the case where speed of transferring the material was particularly high so that problems occurred frequently.

Recently, however, tension loops being loopers such as loop cars or the like have been utilized.

For simplicity, an example in which a loop car is utilized as a looper will be described hereinbelow. FIG. 1 is a system diagram showing a conventional control unit for driving a single loop car in which each loop car 5 of two strands is driven by means of one rope. And these two ropes are wound around one rope drum 3 so that four strands are simultaneously controlled in this unit.

Meanwhile, a purpose for the use of such loop car resides in that a difference in speed between its processing section and an adjacent section, in other words, the difference between the processing section and its inlet or outlet section is absorbed. For this reason, the loop car is disposed in between the processing section being continuously operated and a section where the operation is stopped for welding or dividing a travelling material. Accordingly, a strip 7 stored in the loop car is supplied to the processing section during stop of the operation. On the other hand, when the operation is started, a speed of the inlet section is adjusted to make it higher than that of the processing section, thereby storing the strip 7. When the strip 7 stored in the loop car reaches to a certain amount, the speed of the inlet section is synchronized with that of the processing section, and the operation is again stopped for welding the travelling material. Although the above explanation was made upon such a case where a loop car is placed on the inlet side of the processing section, such a case where another loop car is placed on the outlet side thereof will be also easily understood. As described above, loop cars are an important apparatus being indispensable for continuous processing line.

Next, a construction of a conventional unit as shown in FIG. 1 will simply be described hereinbelow. In FIG. 1, reference numeral 1 designates a bridle motor on its inlet side, while numeral 2 designates another bridle motor on the outlet side, and these motors control speed in each section. Reference numeral 3 designates a drum around which two wire ropes are wound, and loop cars 5 placed on the upper and lower stages are arranged in such that these loop cars are travelled on rails (not shown) by means of the wire ropes extending from the drum 3, respectively. The strip 7 being a travelling material is in four strand form by means of the loop cars 5 in two stages. The drum 3 is driven by a motor 8. Furthermore, each speed of the motors 1, 2 and 8 is detected by means of speed generators 10*a*, 10*b* and 10*c*, respectively. Moreover, reference numeral 13 designates a power unit for the driving motor, 14 a torque controlling circuit, 15 a speed dead band, 16 a speed controlling circuit, 20 a speed command circuit, and 22 a tension presetting means, respectively. Tension of the loop cars 5 is preset by means of the tension presetting means 22, and travelling speed of the loop cars 5 is determined by a difference in speed between the bridle motor 1 on the inlet side and the bridle motor 2 on the outlet side. Namely, the loop cars transfer towards the right side in the drawing, respectively, in the case where a speed of the motor 1 is faster than that of the motor 2, whilst the loop cars transfer towards the left side in the drawing, respectively, in the case where a speed of the motor 1 is slower than that of the motor 2, Furthermore, the loop cars stop in the case where speeds of both the motors 1 and 2 are equal to each other.

As mentioned above, important functions which should be possessed by the loop cars are that there is a large amount of the strip 7 stored, that there is found a little meandering of the strip 7 in the loop cars, and that there is a little fluctuation of tension at the time of starting and stopping the unit. However, with growing speeding up of continuous processing line, there is a limit in a driving means for a single loop car in order to satisfy important functions of the loop cars as described above. Thus, it is required to provide a driving means for plural loop cars. More specifically, the detailed reasons required for providing such driving means for plural loop cars are as follows.

There are two ways for increasing an amount of the stored strip in a single loop car; either the number of strands is increased or an amount of the loop car travel is increased. However, these two ways have also the following disadvantages.

Increase in number of strands brings about increase in bending loss as well as mechanical loss of a strip. Therefore it is required to increase difference in tension between the strip positioned on the uppermost stage and the strip positioned on the lowermost stage. In this respect, it is impossible to increase the difference in tension as mentioned above in a driving means for a single loop in which the whole strands are controlled in a lump. On the other hand, such way in which amount of the loop car travel is increased without increasing number of strands accompanies increase in mechanical loss, and after all, this way has also the disadvantages as mentioned above. Besides, stable operation becomes impossible, because meandering of the strip is amplified in these ways.

SUMMARY OF THE INVENTION

It is an object of the present invention to eliminate such disadvantages as mentioned above in a conventional control unit through a provision of a control unit for driving plural loopers in which such plural loopers are utilized, and the amount of travel of each looper and each position thereof are adjusted to follow one another with the same ratio, whereby bending loss and mechanical loss of the strip is decreased so that stable operation comes to be possible.

According to one aspect of the present invention, there is provided a control unit for driving plural loopers comprising a plurality of loopers each disposed on the route of a transferring material and the aforesaid loopers being moved by means of separate driving means, speed command controlling circuits for controlling a speed of aforesaid driving means by detecting each speed of inflow and outflow of the aforesaid transferring material such that the aforesaid plural loopers are moved with the same ratio in respect of the whole length of each amount of travel each looper, means for detecting each position of the aforesaid loopers, and controlling circuits for positional signal each affording a signal to the speed command controlling circuit for a certain reference looper by means of signals supplied from the aforesaid means for detecting positions of the aforesaid loopers such that the aforesaid reference looper follows another looper with the same ratio in respect of the position of the latter looper.

DESCRIPTION OF A PREFERRED EMBODIMENT

Figure 1:
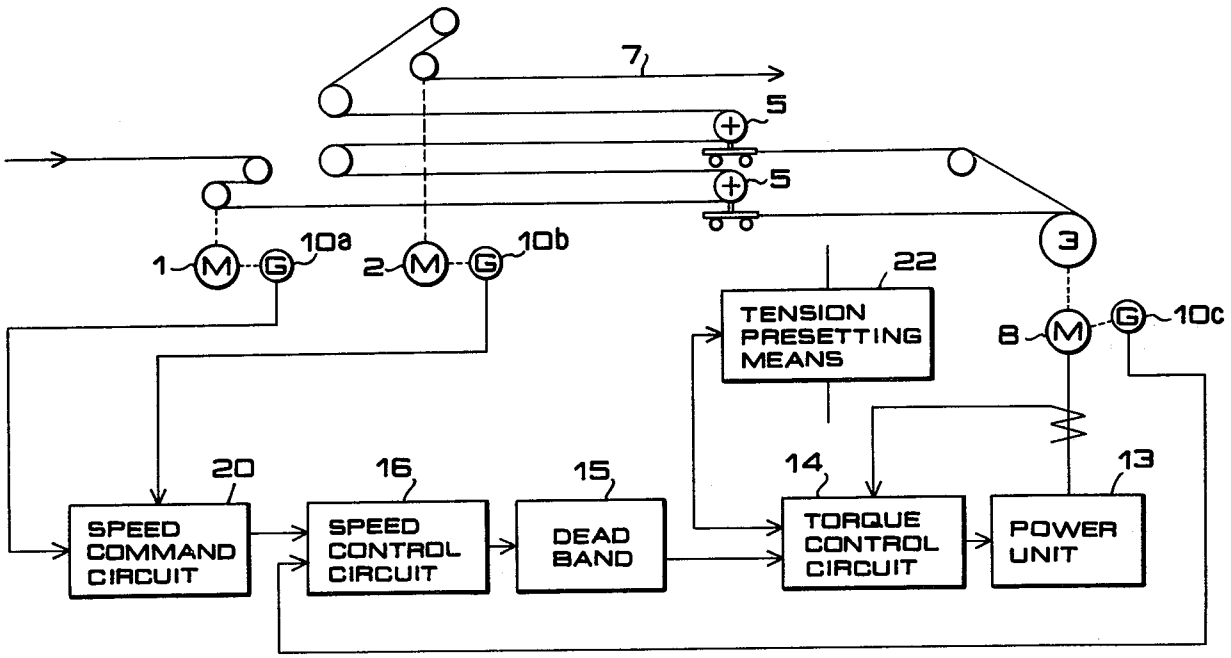
FIG. 1 (PRIOR ART)
FIG. 1 is a system diagram showing a conventional control unit for driving a single loop car.
Figure 2:
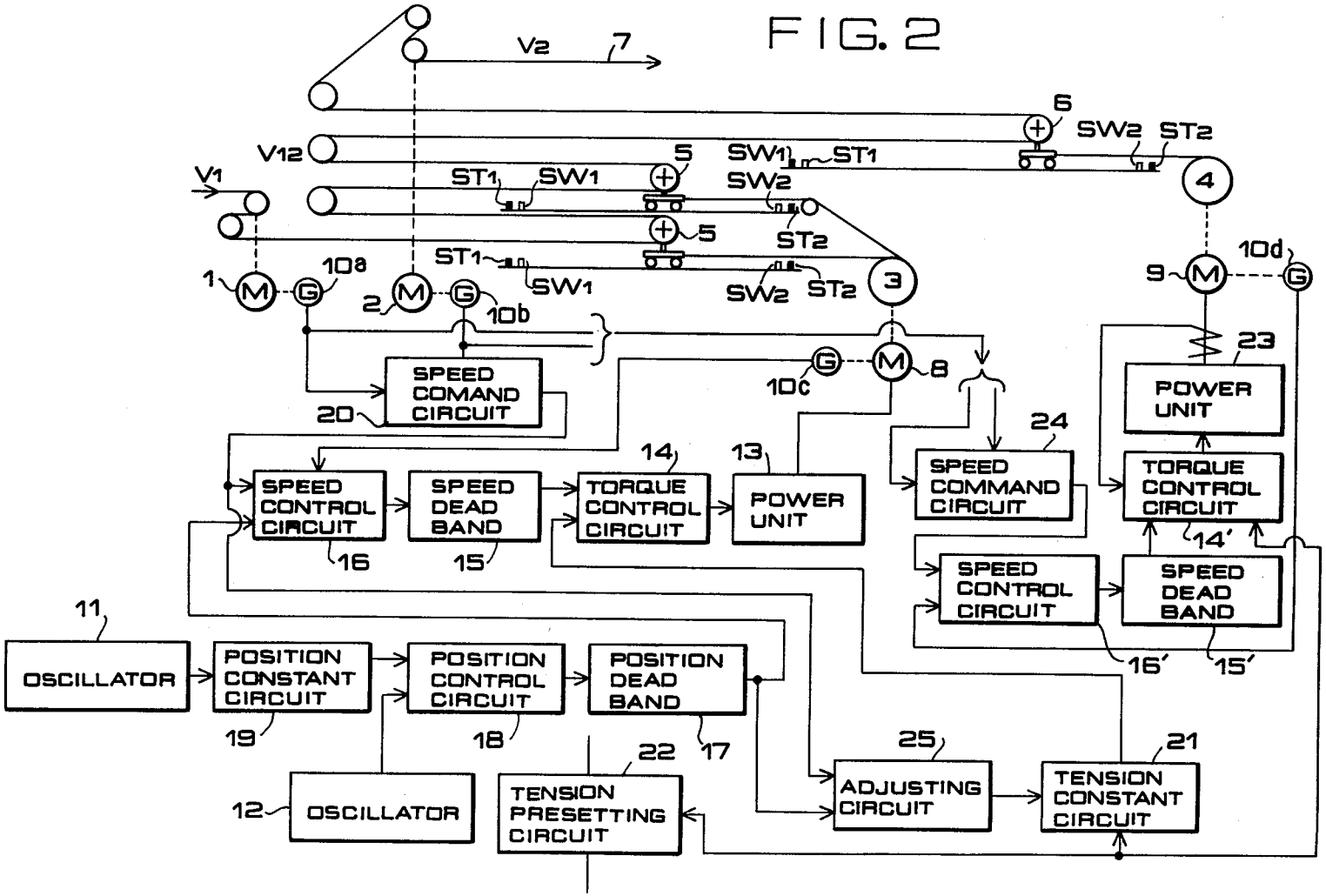
FIG. 2 is a system diagram illustrating an embodiment of the control unit for driving plural loopers according to the present invention.

FIG. 2 is a system diagram showing a control unit for driving plural loopers according to this invention in which the same or like parts in FIG. 2 are shown by corresponding reference numerals of FIG. 1, respectively. Namely, numeral 1 designates a bridle motor on its inlet side, 2 a bridle motor on the outlet side, and 3 a drum around which two wire ropes for a No. 1 loop car (or reference looper) are wound, respectively. Reference numeral 4 designates a drum around which one wire rope for a No. 2 loop car 6 is wound, No. 1 loop cars 5 having four strands, the No. 2 loop car 6 having two strands. FIG. 2 illustrates a case in which the No. 1 loop cars 5 differ from the No. 2 loop car 6 in amount of travel. Reference numeral 7 designates a strip being a transferring material, 8 a motor for driving the No. 1 loop car drum 3, 10*a*–10*d* speed generators detecting each speed of the motors 1, 2, 8 and 9, 11 a position detector of the No. 1 loop cars and being attached to the No. 1 loop car drum 3, 12 another position detector of the No. 2 loop car and being attached to the No. 2 loop car drum 4, 13 a power unit for driving the motor 8, 14 and 14' torque controlling circuits, 15 and 15' speed dead bands, and 16 and 16' speed controlling circuits, respectively. Each signal is inputted to the torque controlling circuits 14 and 14' through the dead bands 15 and 15' by means of the speed controlling circuits 16 and 16', respectively. Furthermore, a signal from a tension presetting means 22 is inputted to the torque controlling circuit 14 by way of a tension constant circuit 21. Output from a No. 1 loop car speed command circuit 20 is transmitted to one of the inputs directed to the speed controlling circuit 16. Moreover, output from a position controlling circuit 18 is transmitted to another input of the speed controlling circuit 16 through a position dead band 17. The speed command circuit 20 generates command signals based on the signals supplied from speed generators 10*a* and 10*b* attached to the bridle motor 1 on the inlet side and to the bridle motor 2 on the outlet side, respectively. Reference numeral 19 designates a position constant circuit, 24 a speed command circuit for the No. 2 loop car corresponding to the No. 1 loop car speed command circuit, and 25 a No. 1 loop car tension constant automatically adjusting circuit by which the tension constant circuit 21 is controlled to preset a No. 1 loop car tension. A controlling circuit for speed command in respect of the No. 1 loop car is composed of the circuits 14, 15, 16, 20 and 22, whilst a controlling circuit for speed command in respect of the No. 2 loop car is composed of the circuits 14', 15', 16', 22 and 24. Further, reference characters $SW_1$ and $SW_2$ designate limit switches, and $ST_1$ and $ST_2$ stoppers, respectively.

Operation of the control unit for driving plural loopers shown in FIG. 2 will be described hereinbelow.

The speed command circuits 20 and 24 preset separately speeds of the respective loop cars 5 and 6, but these speeds have the following relationship.

Namely, the loop cars 5 and 6 travel with the same ratio in respect to the whole lengths of the respective amounts of travel of the loop cars (effective lengths), more specifically, the loop cars 5 and 6 travel with the same ratio in reference to the respective distances between the limit switches $SW_1$-$SW_2$ provided on the rails, that is, both the loop cars 5 and 6 travel the same % positions at the same time, respectively. In other words, the speed command circuits 20 and 24 are preset such that the loop cars 5 and 6 travel over the whole lengths in the same time. The position constant circuit 19 converts the whole length with the same ratio such that the position of the No. 2 loop car is followed by the No. 1 loop car 5.

Moreover, the position dead band 17 being an important function of the present invention corrects positional deviation of the loop car 5 from the loop car 6 through operation of the position controlling circuit 18 at the time when such positional deviation exceeding a certain value takes place.

Circuit characteristics of the position dead band 17 and the position controlling circuit 18 relating to such correction of positional deviation is arranged such that its gain is high in the direction along which ropes are wound, while such gain is low in the direction along which the ropes are unwound. Such arrangement is taken into consideration because of controlling the loop car 5 by means of the ropes.

Furthermore, the tension constant automatically adjusting circuit 25 controls a ratio between tensions of the No. 1 loop car and the No. 2 loop car.

When the loop cars 5 and 6 stop at certain positions, each loop car is operated under control of tension which is a basic operation. However, since there are two loop cars which are subjected to tension controlling within the same section (extended between $SW_1$-$SW_2$), positions of the loop cars vary, when deviation in tension of the loop car 5 from the loop car 6 exceeds a certain value. After all, though the No. 1 and No. 2 loop car tensions are determined according to principle of pulley, if the mechanical loss is not taken into consideration, these loop cars cannot be controlled at the same % positions. Since a loop car possesses friction loss (between wheel and rail, and so on), position of the loop car cannot be changed if deviation in tension does not exceed a certain value.

And change in position of such loop car corrects a position of the loop car 5 through the position controlling circuit 18. Further, when the loop car 5 is again subjected to tension control, positional deviation occurs. The positional deviation is called a swinging cycle. As a result, the tension constant automatically adjusting circuit 25 prolongs swinging cycle of the loop car 5, or stops the swinging of the loop car 5, if necessary. More specifically, a ratio of No. 1 loop car tension is determined on the basis of a tension presetting value of the No. 2 loop car in accordance with principle of pulley. In the case where strip speed $V_1=V_2$, the No. 1 and No. 2 loop cars 5 and 6 do not function for speed control, but for torque control of loop car motors. If it is assumed that deviation takes place between % positions of the No. 1 loop car 5 and the No. 2 loop car 6, correction of such positions is effected by increasing or decreasing a torque value on the No. 1 loop car. The tension constant automatically adjusting circuit 25 is added to the present unit in order to minimize such swinging frequency.

Operation of the tension constant automatically adjusting circuit 25 is such that tension constant is changed so as to minimize the number of times of operation for swinging control by means of the position dead band 17 through the tension constant automatically adjusting circuit 25 in the case where signal from the speed command circuit 20 is zero, in other words, speed of the bridle motor 1 is identical to that of the bridle motor 2. The above-mentioned identical speed of the bridle motor 1 to that of the bridle motor 2 means that $V_1=V_2$ so that loop car speed becomes zero, while amount of storing strip in a loop car section does not vary. In this case, such loop car effects current control of a loop car motor in order to not perform speed control, but loop car tension control.

Moreover, a tension constant automatically adjusting circuit which functions to minimize the number of times in operation is a kind of learning control and in which torque value of a loop car is changed by means of a pattern obtained from swinging frequency of the loop car in order to effect position control.

As is apparent from the above description, an embodiment of the present invention has been explained with reference to the case in which loop carriages are moved in horizontal direction. Of course, such control unit is also effective for the case of strand loopers in which the loop carriages are moved in vertical direction.

As described above, the present invention utilizes plural loopers, and each amount of travel of each looper and each position thereof are adjusted to follow one another with the same ratio. Therefore, the control unit according to the present invention can stably be appliled to a high-speed continuous process line without accompanying any modification such as increase of number of strands or increase of amount of travel of a looper as in a conventional control unit. Furthermore, there is provided a control unit for driving loopers possessing only slight bending loss and mechanical loss of the strip in accordance with the present invention. Besides, the present invention has such remarkable advantages in that swinging frequency of loopers can be controlled, and that stable control can be effected for driving the loopers, because tension constant automatically adjusting circuit functions are added to the control unit.

What is claimed is:

1. A control unit for driving plural loopers comprising:

(a) a plurality of loopers including a reference looper each disposed on the route of a transferring material and said plurality of loopers being moved by means of separate driving means;

(b) speed command controlling circuits for controlling a speed of said driving means by means for detecting each speed of inflow and outflow of said transferring material such that said plural loopers are moved with the same ratio in respect of the whole length of each amount of movement of each looper;

(c) means for detecting each position of said loopers; and (d) controlling circuits for positional signal each affording a signal to the speed command controlling circuit for said reference looper by means of signals supplied from said means for detecting positions of said loopers such that said reference looper follows another of said plurality of loopers with the same ratio in respect of the position of the latter looper.

2. A control unit for driving plural loopers as defined in claim 1, wherein said reference looper has a swinging cycle, and further comprising a tension constant automatically adjusting circuit for controlling the swinging cycle of the reference looper by inputting signals from said controlling circuits for positional signal and from said means for detecting each speed of inflow and outflow of said transferring material to said circuit.

* * * * *

UNITED STATES PATENT AND TRADEMARK OFFICE

CERTIFICATE OF CORRECTION

PATENT NO. : 4,474,321

DATED : October 2, 1984

INVENTOR(S) : Haruo Komoto and Shigeharu Hamada

It is certified that error appears in the above-identified patent and that said Letters Patent is hereby corrected as shown below:

Column 2, line 26, after the numeral "2" the "," should be a --.--.

Column 6, lines 7 and 8, "appliled" should read --applied--.

Signed and Sealed this

*Twenty-eighth* Day of *May 1985*

[SEAL]

*Attest:*

DONALD J. QUIGG

*Attesting Officer*

*Acting Commissioner of Patents and Trademarks*